US005205560A

United States Patent [19]

Hoshi et al.

[11] Patent Number: 5,205,560

[45] Date of Patent: Apr. 27, 1993

[54] GOLF CLUB HEAD

[75] Inventors: Toshiharu Hoshi; Takashi Iijima; Atsushi Tsuchida, all of Hamamatsu, Japan

[73] Assignee: Yamaha Corporation, Hamamatsu, Japan

[21] Appl. No.: 766,825

[22] Filed: Sep. 26, 1991

[30] Foreign Application Priority Data

Sep. 27, 1990 [JP] Japan ..... 2-258234

[51] Int. Cl.[5] ..... A63B 53/08

[52] U.S. Cl. ..... 273/167 H; 273/78

[58] Field of Search ..... 273/167-175, 273/78, 77 R, 193 R, 194 R, 183 D, 183 E, 186 R, 194 A

[56] References Cited

U.S. PATENT DOCUMENTS

| | | | |
|---|---|---|---|
| 708,575 | 9/1902 | Mules | 273/78 |
| 777,400 | 12/1904 | Clark | 273/78 |
| 1,359,220 | 11/1920 | Beamer | 273/78 |
| 3,387,844 | 6/1968 | Shippee | 273/78 |
| 3,989,248 | 11/1976 | Campau | 273/78 |
| 4,021,047 | 5/1977 | Mader | 273/167 H |
| 4,432,549 | 2/1984 | Zebelean | 273/167 H |
| 4,602,787 | 7/1986 | Sugioka et al. | 273/171 |
| 4,749,197 | 6/1988 | Orlowski | 273/173 |
| 4,754,969 | 7/1988 | Kobayashi | 273/78 X |
| 5,028,049 | 7/1991 | McKeighen | 273/167 H |

FOREIGN PATENT DOCUMENTS

| | | | |
|---|---|---|---|
| 595117 | 1/1978 | Switzerland | 273/167 H |

OTHER PUBLICATIONS

"Golf Digest" Magazine, Jan. 1978, issue, pp. 112, 113.

*Primary Examiner*—V. Millin
*Assistant Examiner*—Sebastiano Passaniti
*Attorney, Agent, or Firm*—Spensley Horn Jubas & Lubitz

[57] ABSTRACT

A hollow metallic wood club head formed of a superplastic metallic material to have a crown portion, a hitting face portion and a sole portion, wherein the rigidity of the crown portion is determined to be lower than that of the sole portion so that the loft angle of the face portion is increased at the moment of impact against a golf ball in an angle range of 0.5°-2.5°, and wherein the metallic average grain size of the crown portion is determined to be less than 50 micron.

5 Claims, 4 Drawing Sheets

GOLF CLUB HEAD

BACKGROUND OF THE INVENTION

1. Field of the Invention

The present invention relates to golf club heads, more particularly to hollow metallic wood club heads.

2. Description of the Prior Art

In a recent development of wood clubs such as a driver and fairway clubs, there have been proposed various kinds of "metalwoods", in which the head has the shape of a traditional wood but formed of metal such as stainless steel or aluminium alloy, molded in a hollow form by the lost-wax casting process. The hitting surface or "face" of the metallic head is formed at a loft angle preselected in accordance with the number of the wood club. Since the loft angle at the moment of impact is retained at the preselected angle, the golf ball is applied with back spin and tends to be floated up by the lift force acting thereon in the air, resulting in decrease of its flight distance or carry and decrease of its run after drops on the ground.

During the lost-wax casting process, it is extremely difficult to control the grain size of the metal structure. As a result, the grain size of the metal structure becomes relatively large, resulting in deterioration of the rigidity of the metallic head. Since the shell of the hollow metallic head may not be thinned for the foregoing reason, the metallic head may not be enlarged without causing any increase of its weight. Accordingly, the sweet spot area of the metallic head is, in general, narrow, and the directional stability of the ball is poor.

SUMMARY OF THE INVENTION

It is, therefore, a primary object of the present invention to provide a hollow metallic wood club head having a crown portion the wall thickness of which is made as thin as possible by control of its grain size and the rigidity of which is made lower than that of the underside or sole portion of the head to cause "a gear effect" at the moment of impact thereby to increase the flight distance of the ball and to enlarge the sweet spot area of the head for enhancing the directional stability of the ball.

In an aspect of the present invention, there is provided a hollow metallic wood club head having a crown portion the grain size of which is determined to be less than 50 micron. With such determination of the grain size, the crown portion can be made as thin as possible without causing any decrease of its rigidity. In another aspect of the present invention, there is provided a hollow metallic wood club head having a crown portion the rigidity of which is determined to be lower than that of the sole portion of the head. With such determination of the rigidity, the loft angle of the club head is increased at the moment of impact in an angle range of 0.5° to 2.5° so that an amount of back spin acting on the ball is reduced by the gear effect to increase the flight distance of the ball.

DESCRIPTION OF THE PREFERRED EMBODIMENT

Figure 1:
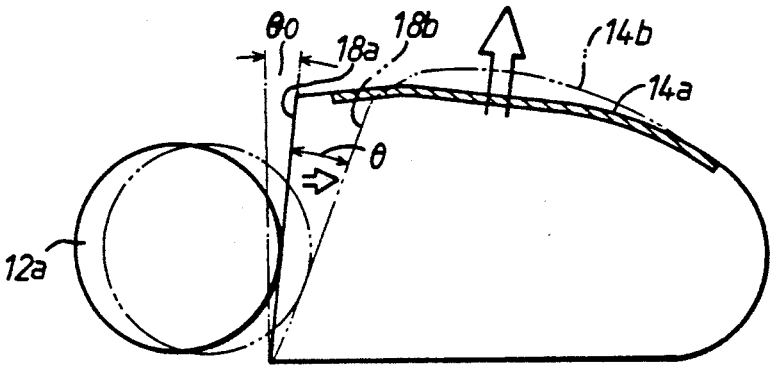
FIG. 1 is a view illustrating a hollow metallic wood club head at the moment of impact against a golf ball.
Figure 2:
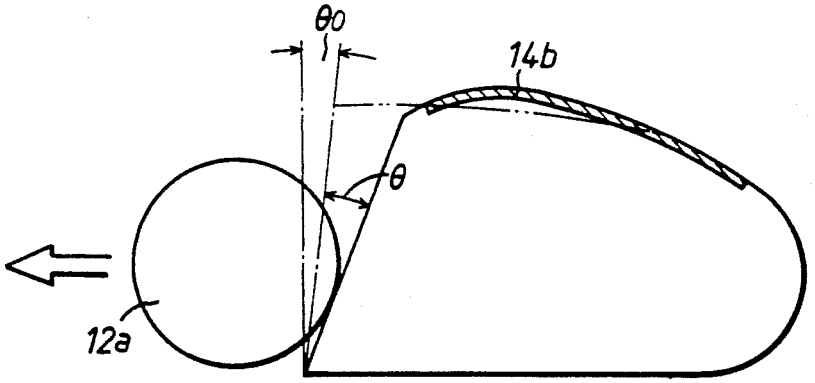
FIG. 2 is a view illustrating the loft angle of the club head increased at the impact.
Figure 3:
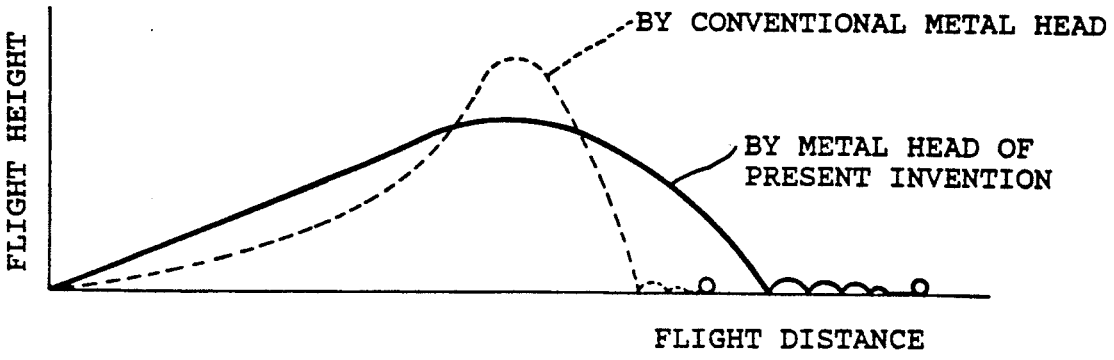
FIG. 3 is a graph showing a flight height in relation to a flight distance.

Referring to the drawings, FIG. 1 schematically illustrates a hollow metallic wood club head of the present invention at the moment of impact against a golf ball 12*a*. A crown portion of the club head at the moment of impact is indicated by the reference numeral 14*a*, and a loft angle of the hitting surface 18*a* of the club head is indicated by the reference character $\theta_o$. At the moment of impact, the crown portion 14*a* of the club head is flexed by the impact as shown by an imaginary line 14*b* to increase the loft angle of hitting surface 18*a* by an angle $\theta$ as shown by an imaginary line 18*b*. It is preferable that the increase amount $\theta$ of the loft angle is defined to be 0.5°–3.0°. More preferably, the increase amount $\theta$ of the loft angle is defined to be 1.0°–2.5°. When the loft angle was increased by flexure of the crown portion 14*a* at the moment of impact, the ball 12*a* is applied with a downward rotational force caused by frictional engagement with the hitting surface 18*a* of the club head. This is effective to reduce an amount of back spin acting on the ball 12*a* thereby to increase the flight and run distances as shown by a solid curve in FIG. 3. In the present invention, the downward rotational force acting on the ball 12 is called "a gear effect".

In contrast with the metallic wood club head of the present invention, the preselected loft angle of a conventional metallic wood club head does not increase at the moment of impact against the golf ball. Thus, the ball is applied with back spin caused by an upward rotational force acting thereon at the moment of impact. If the amount of back spin is large, a lift force acting on the ball becomes large. As a result, the flight and run distances of the ball become short as shown by a dotted curve in FIG. 3.

In the forming process of the metallic wood club head, the rigidity of the club head can be controlled by adjustment of the wall thickness of the crown portion, the hitting face portion and the sole portion. The adjustment of the wall thickness is carried out in consideration with Young's modulus of the material for the club head and a radius of curvature of the crown portion. The preferred materials of the club head are stainless steel, ferro alloys, aluminium alloys, magnesium alloys, titanium alloys, Ti-Al alloys and Zn-Al alloys. The grain size of the materials can be controlled by rolling or forging, and the club head is formed by a press-forming process and welding or a superplastic forming process and welding or diffusion bonding as will be described later.

Figure 4:
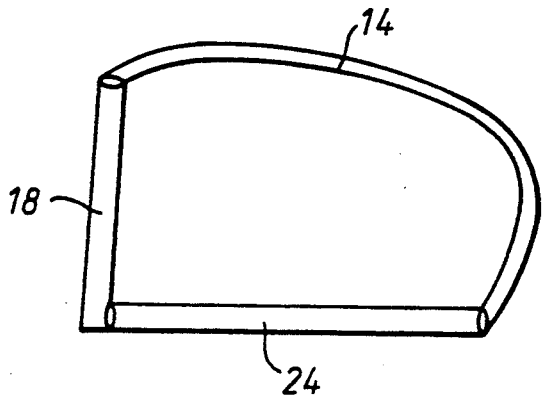
FIG. 4 is a schematic illustration of the shell structure of the hollow metallic wood club head.

FIG. 4 schematically illustrates a shell structure of a first preferred embodiment of a hollow metallic wood club head according to the present invention, in which the metallic wood club head has a crown portion 14, a hitting face portion 18 and a sole portion 24. The loft angle $\theta$ of the face portion 18 is determined to be 10°, the head weight is 210 g, and the head volume is 200 cc. For manufacturing the hollow metallic wood club head, a sheet metal of Ti-6Al-4V alloy in thickness of 3 mm was cut out to provide the crown portion 14, face portion 18 and sole portion 24. The crown portion 14 was formed by hot pressing and jointed to the face and sole portions by welding to obtain the club head. The hosel of the club head was formed by a pipe of the same material and welded to the heel of the club head. The average grain size of the club head was determined to be approximately 10 micron, the proof stress was 110 kg/mm$^2$, the tensile strength was 125 kg/mm$^2$, and the breaking stretch was 8%.

For hitting tests, several sample metallic club heads were produced to have a crown portion of different wall thickness. The test results of the club heads are shown in the following Table 1 for comparison of the hitting performance. In the hitting tests, the head speed was determined to be 50 m/sec.

TABLE 1

| Crown Thickness | Crown Distortion | Increase of Loft Angle | Carry (yds) | Run (yds) | Total (yds) |
|---|---|---|---|---|---|
| 2.0(mm) | 0.044(%) | 0.312° | 249.8 | 27.2 | 277.0 |
| 1.8 | 0.053 | 0.425° | 250.2 | 27.9 | 278.1 |
| 1.6 | 0.068 | 0.613° | 250.5 | 29.9 | 280.4 |
| 1.4 | 0.090 | 0.913° | 250.8 | 31.5 | 282.3 |
| 1.2 | 0.123 | 1.450° | 251.2 | 35.4 | 286.6 |
| 1.0 | 0.175 | 2.500° | 252.0 | 39.1 | 291.1 |

From the Table 1, it has been found that the distortion amount of the crown portion and the loft angle of the face portion are increased in accordance with reduction of the wall thickness of the crown portion. This was effective to make the carry and run distances of the ball more longer.

Durability Test (1)

Figure 5:
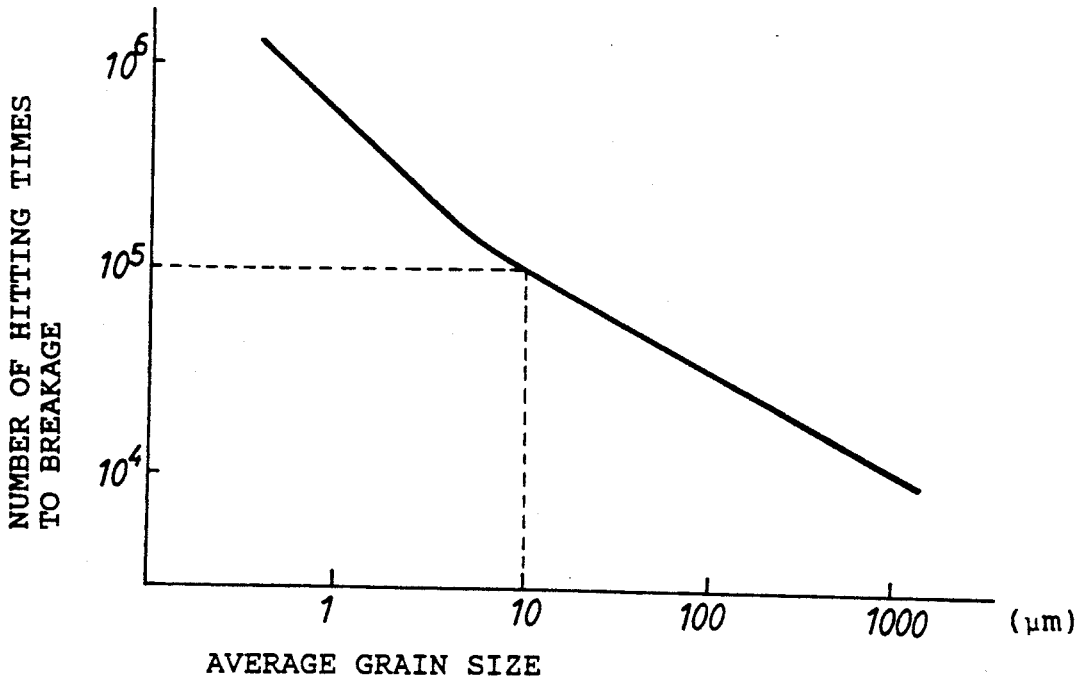
FIG. 5 is a graph showing the number of hitting times in relation to an average grain size.

A metallic club head having a crown portion the wall thickness of which is 1.2 mm and the average grain size of which is 1.0–1000 micron was put to the durability test by trial hitting of golf balls. In FIG. 5, there is illustrated the test result of durability wherein the number of hitting times to breakage is represented in relation to the average grain size of the metallic club head. From the graph of FIG. 5, it has been found that the durability of the metallic club head is enhanced in accordance with decrease of the average grain size.

Directional Stability Test

Figure 6:
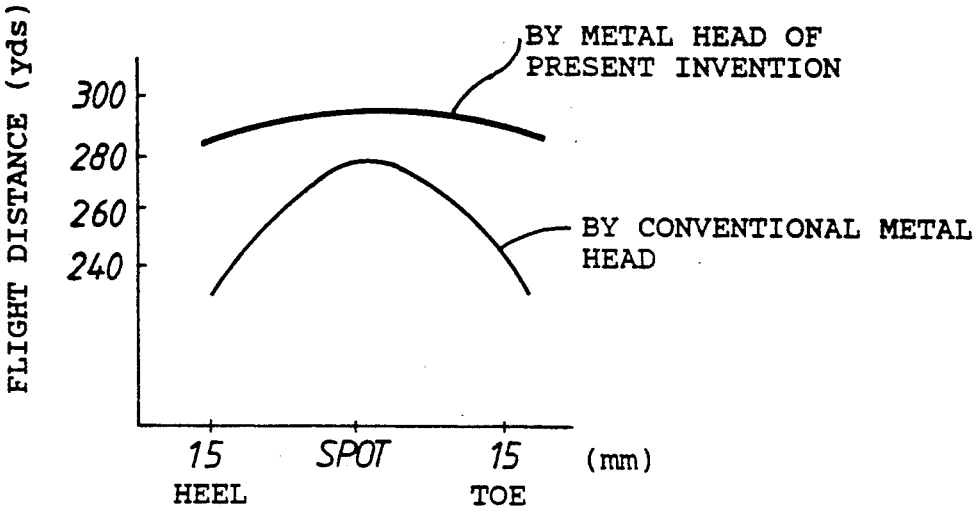
FIG. 6 is a graph showing a flight distance of a golf ball hitted by a first test piece of the club head in relation to hitting positions of the club head.

A sample metallic club head produced by the manufacturing method of the first preferred embodiment was put to the directional stability test for comparison with a conventional metallic club head produced by a precision casting process known as the lost-wax casting process. The sample metallic club head was formed of the same material as that of the first preferred embodiment to have a crown portion the wall thickness of which is 1.0 mm and a volume of 250 cc. The conventional metal head was formed to have a crown portion the wall thickness of which is 1.6 mm and a volume of 200 cc. In FIG. 6, there is illustrated the test result of the sample metallic club head wherein flight distances of the golf balls hit by the metallic club heads are represented in relation to hitting positions of the metallic club heads. From the graph of FIG. 6, it has been found that the sweet spot area of the sample metallic club head is broader than that of the conventional metallic club head. This is effective to enhance the directional stability of the balls hitted by the metallic club head.

Durability Test (2)

The sample metallic club head produced by the manufacturing method of the first preferred embodiment was put to the durability test for comparison with the conventional metallic club head produced by the precision casting process. The sample metallic club head was formed to have a crown portion the wall thickness of which is 1.2 mm and a volume of 250 cc, while the conventional metallic club head was formed to have a crown portion the wall thickness of which is 1.6 mm and a volume of 200 cc. In the following Table 2, the test result of the sample metallic club head is shown in comparison with the conventional metallic club head.

TABLE 2

| | Average crystalline particle diameter | Number of hitting times to breakage |
|---|---|---|
| Conventional metal head | 800.0 (μm) | $2 \times 10^4$ |
| Sample metal head | 3.0 (μm) | $5 \times 10^5$ |

From the Table 2, it has been found that the average grain size of the sample metallic club head can be controlled in a small value for greatly enhancing the durability.

Figure 7:
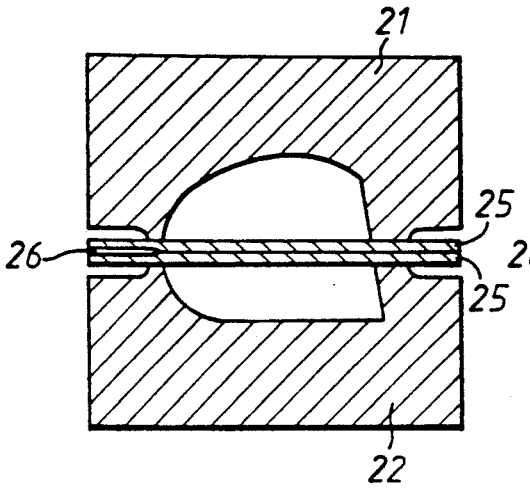
FIG. 7 is a sectional view showing sheet metals clamped by upper and lower mold blocks.
Figure 8:
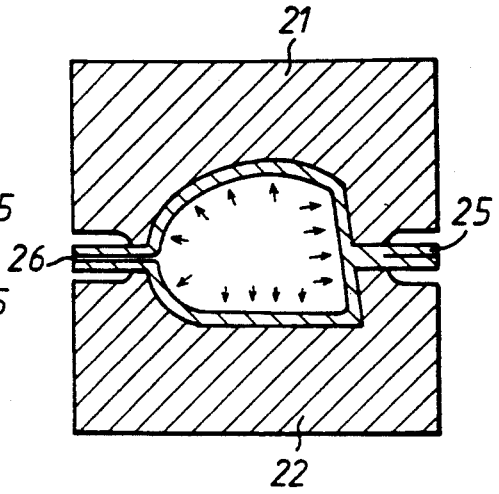
FIG. 8 is a sectional view showing a forming process of the sheet metals in an internal cavity formed by the upper and lower mold blocks.
Figure 10:
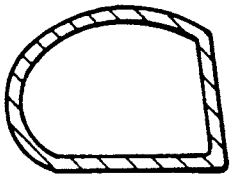
FIG. 10 is a sectional view of a finished metallic wood club head.
Figure 9:
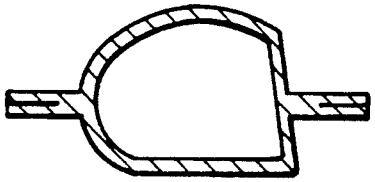
FIG. 9 is a sectional view of the molded sheet metals.

In FIGS. 7 to 10, there is illustrated a superplastic forming process for manufacturing a metallic club head of the present invention. In this superplastic forming process, two superplastic sheet metals of Ti-6Al-4V alloy in thickness of 4 mm are clamped between split mold blocks 21 and 22 as shown in FIG. 7. In a condition where the mold blocks 21, 22 have been heated to 900° C., argon gas under pressure is injected into a channel groove 26 of the upper sheet metal 25 to superplastically deform the sheet metals 25 into the interior shape of the mold blocks 21, 22 as shown in FIG. 8. Thus, the deformed sheet metals 25 are integrally jointed by diffusion bonding at their clamped portions and removed from the mold blocks 21, 22 as shown in FIG. 9. Subsequently, the clamped portions of the sheet metals are cut off to obtain a sample metallic club head as shown in FIG. 10. The average grain size of the sample metallic club head was determined to be 0.003 mm. In the following Table 3, the hitting test result of the sample metallic club head is represented in comparison with the conventional metallic club head produced by the pressforming process and welding.

TABLE 3

| | Carry (yds) | Run (yds) | Total (yds) |
|---|---|---|---|
| Conventional Metal Head | 251 | 35 | 286 |
| Sample Metal Head | 260 | 35 | 295 |

From the Table 3, it has been found that the hitting performance of the sample metallic club head is better than the conventional metallic club head.

As a third preferred embodiment of the present invention, two-phase stainless alloy sheet metals of 25Cr- 6.5Ni-3.2Mo-1N-Fe were used to obtain a sample metallic club head by the superplastic forming process described above. The sample metallic club head was formed to have a loft angle of 8.5°, an average grain size of 0.003 mm, a crown portion of 0.8 mm thickness and a volume of 180 cc. For comparison with the sample metallic club head, a stainless steel club head was produced by a conventional precision casting process to have a loft angle of 8.5°, an average grain size of 0.5 mm, a crown portion of 1.0 mm thickness and a volume of 150 cc. In the following Table 4, the hitting test result of the sample metallic club head at a head speed of 40 m/sec is represented in comparison with the stainless steel club head.

TABLE 4

| | Increase of Loft Angle | Carry (yds) | Run (yds) | Total (yds) |
|---|---|---|---|---|
| Sample Metal Head | 2.5° | 252 | 39 | 291 |
| Stainless Steel Head | 0 | 250 | 30 | 280 |

Figure 11:
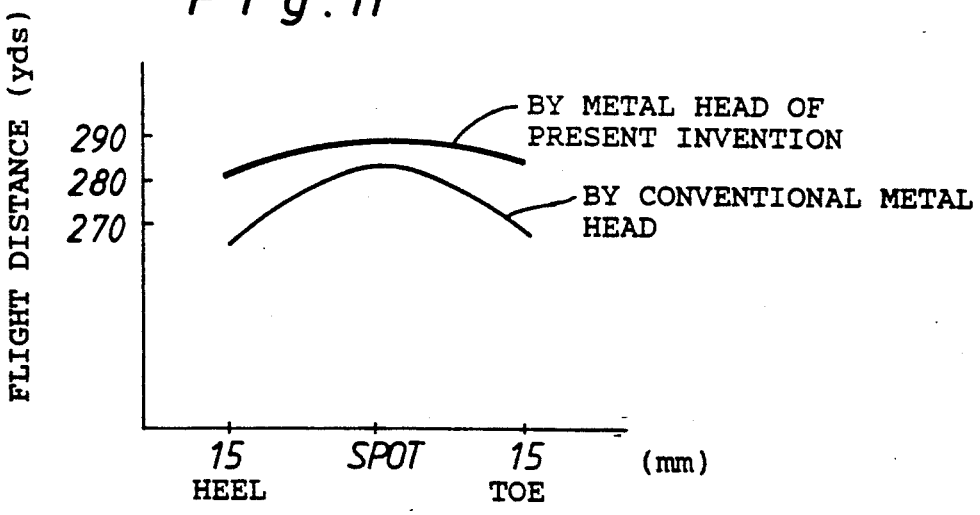
FIG. 11 is a graph showing a flight distance of a golf ball hitted by a second test piece of the club head in relation to hitting positions of the club head.

From the Table 4, it has been found that the hitting performance of the sample metallic club head is better than the stainless steel club head. In FIG. 11, there is illustrated the hitting test result of the sample metallic club head wherein flight distances of the golf balls hit by the metallic club heads are represented in relation to hitting positions of the metal heads. From the graph of FIG. 11, it has been found that the sweet spot area of the sample metallic club head is broader than that of the stainless steel club head. This is effective to enhance the directional stability of the balls.

What is claimed:

1. A hollow metallic wood club head formed of a superplastic metallic material, the club head having a crown portion, a hitting face portion having a loft angle and a sole portion, said crown portion extending rearwardly of said face portion and disposed generally opposite said sole portion, said crown portion having a rigidity that is lower than the rigidity of said sole portion, wherein the metallic average grain size of the material forming the crown portion enables the crown portion to flex relative to sole portion to increase the loft angle of said face portion within an angle range of 0.5 to 2.5 degrees at the moment of impact against a golf ball.

2. A hollow metallic wood club head as claimed in claim 1, wherein the metallic average grain size of the metallic material forming said crown portion is determined to be less than 50 micron.

3. A hollow metallic wood club head as claimed in claim 2, wherein said superplastic metallic material is a sheet metal of Ti-6Al-4V alloy.

4. A hollow metallic wood club head as claimed in claim 2, wherein said superplastic metallic material is a sheet metal of 25Cr-6.5Ni-3.2Mo-1N-Fe.

5. A hollow metallic wood club head as claimed in claim 1, wherein the wall thickness of said crown portion is determined to be in a range between 1.0 to 1.6 mm.

* * * * *